US008265935B2

(12) United States Patent
Krig

(10) Patent No.: US 8,265,935 B2
(45) Date of Patent: Sep. 11, 2012

(54) METHOD AND SYSTEM FOR MEDIA PROCESSING EXTENSIONS (MPX) FOR AUDIO AND VIDEO SETTING PREFERENCES

(75) Inventor: Scott Krig, Santa Clara, CA (US)

(73) Assignee: Broadcom Corporation

( * ) Notice: Subject to any disclaimer, the term of this patent is extended or adjusted under 35 U.S.C. 154(b) by 1063 days.

(21) Appl. No.: 12/169,411

(22) Filed: Jul. 8, 2008

(65) Prior Publication Data

US 2009/0048848 A1 Feb. 19, 2009

Related U.S. Application Data

(60) Provisional application No. 60/955,542, filed on Aug. 13, 2007, provisional application No. 61/073,999, filed on Jun. 19, 2008.

(51) Int. Cl.
*G10L 11/00* (2006.01)
*G10L 21/00* (2006.01)

(52) U.S. Cl. ..... 704/270; 704/201; 709/231; 725/87; 725/112

(58) Field of Classification Search ..... 704/201, 704/270

See application file for complete search history.

(56) References Cited

U.S. PATENT DOCUMENTS

2003/0229900 A1* 12/2003 Reisman ..... 725/87
2004/0031058 A1* 2/2004 Reisman ..... 725/112
2007/0011343 A1* 1/2007 Davis et al. ..... 709/231

* cited by examiner

*Primary Examiner* — Justin Rider
(74) *Attorney, Agent, or Firm* — Brinks Hofer Gilson & Lione

(57) ABSTRACT

Device independent Media Processing Extension (MPX) data, corresponding to media data, may be decoded by a media rendering device and may be utilized to determine and/or execute processing steps and/or processing parameters for processing the media data. During the processing and/or rendering, processing steps and/or parameters may be dynamically determined and/or adjusted. A user preference profile, media rendering device profile and/or media rendering environment profile may be utilized to generate, store and/or restore MPX data. Furthermore, MPX data that may be input by a user, manufacturer or a vendor, may be stored in a plurality of ways, for example, within a media data file, an external file and/or within an MTP or PTP object property associated the media data. The media data may comprise one or more of video data, still image data and audio data, for example.

27 Claims, 4 Drawing Sheets

METHOD AND SYSTEM FOR MEDIA PROCESSING EXTENSIONS (MPX) FOR AUDIO AND VIDEO SETTING PREFERENCES

CROSS-REFERENCE TO RELATED APPLICATIONS/INCORPORATION BY REFERENCE

This application makes reference to and claims priority to U.S. Provisional Application Ser. No. 60/955,542 filed on Aug. 13, 2007, entitled "method and system for media processing extensions (MPX) for audio and video setting preferences," which is hereby incorporated herein by reference in its entirety.

This application also makes reference to and claims priority to U.S. Provisional Application Ser. No. 61/073,999 filed on Jun. 19, 2008, entitled "method and system for media processing extensions (MPX) for audio and video setting preferences," which is hereby incorporated herein by reference in its entirety.

FIELD OF THE INVENTION

Certain embodiments of the invention relate to processing data. More specifically, certain embodiments of the invention relate to a method and system for media processing extensions (MPX) for audio and video setting preferences.

BACKGROUND OF THE INVENTION

For many people, media rendering devices which may be stationary, mobile or handheld, have become a part of everyday life. Media rendering technology may be found in many popular devices, for example, digital handheld audio and/or video playback devices, televisions, projection equipment, video and still camera displays, electronic gaming, set top box, medical and scientific equipment, mobile phones, laptops or personal computers and home or commercial entertainment centers.

Media playback devices have become prevalent in the market due to the low cost of communications technology and the ever increasing customer demand for more advanced media delivery systems.

Further limitations and disadvantages of conventional and traditional approaches will become apparent to one of skill in the art, through comparison of such systems with the present invention as set forth in the remainder of the present application with reference to the drawings.

BRIEF SUMMARY OF THE INVENTION

A system and/or method for media processing extensions (MPX) for audio and video setting preferences, substantially as shown in and/or described in connection with at least one of the figures, as set forth more completely in the claims.

Various advantages, aspects and novel features of the present invention, as well as details of an illustrated embodiment thereof, will be more fully understood from the following description and drawings.

DETAILED DESCRIPTION OF THE INVENTION

Certain embodiments of the invention may be found in a method and system for media processing extensions (MPX) for audio and video setting preferences. In this regard, a media rendering device that may be enabled to handle media data and media processing extension (MPX) data, may decode MPX data corresponding to the media data. Based on the decoded MPX data, one or more of processing steps and/or processing parameters for processing the media data may be determined. In this manner, the media data may be processed and/or rendered according to the determination. Notwithstanding, the processing steps and processing parameters may be dynamically determined and/or adjusted during the processing and/or rendering by the media rendering device.

The MPX data may be generated, stored and/or restored based on one or more of a user preference profile, a media rendering device profile and/or a media rendering environment profile. Furthermore, the MPX data may be stored in a plurality of ways, for example, within a file that may comprise corresponding media data, within a file that may be external to the file that may comprise corresponding media data and/or within an MTP or PTP object property associated with the media data. In addition, the MPX data may be input, for example, by a user, manufacturer or a vendor. Moreover, the MPX data may be independent of a specific type of device, for example, MPX data may be effective within a plurality of media devices. In accordance with an embodiment of the invention, the media data may comprise one or more of video data, still image data and/or audio data, for example.

The MPX concept may be implemented and deployed for any media delivery method. For example, the MPX extensions for each specific media item (audio or video) could be stored on a set-top-box, stored in a portable media player, stored in files accompanying the media, stored within the media files, stored as properties of MTP or PTP objects and/or stored on servers. Media Processing Extensions (MPX) is a standard and a device independent method of representing media playback settings for both audio and video media. Settings are stored in a common format which can be saved and restored when the media is played again. For discriminating consumers, the ability to customize the rendering settings for a given media item and save the settings could be a selling point.

Figure 1:
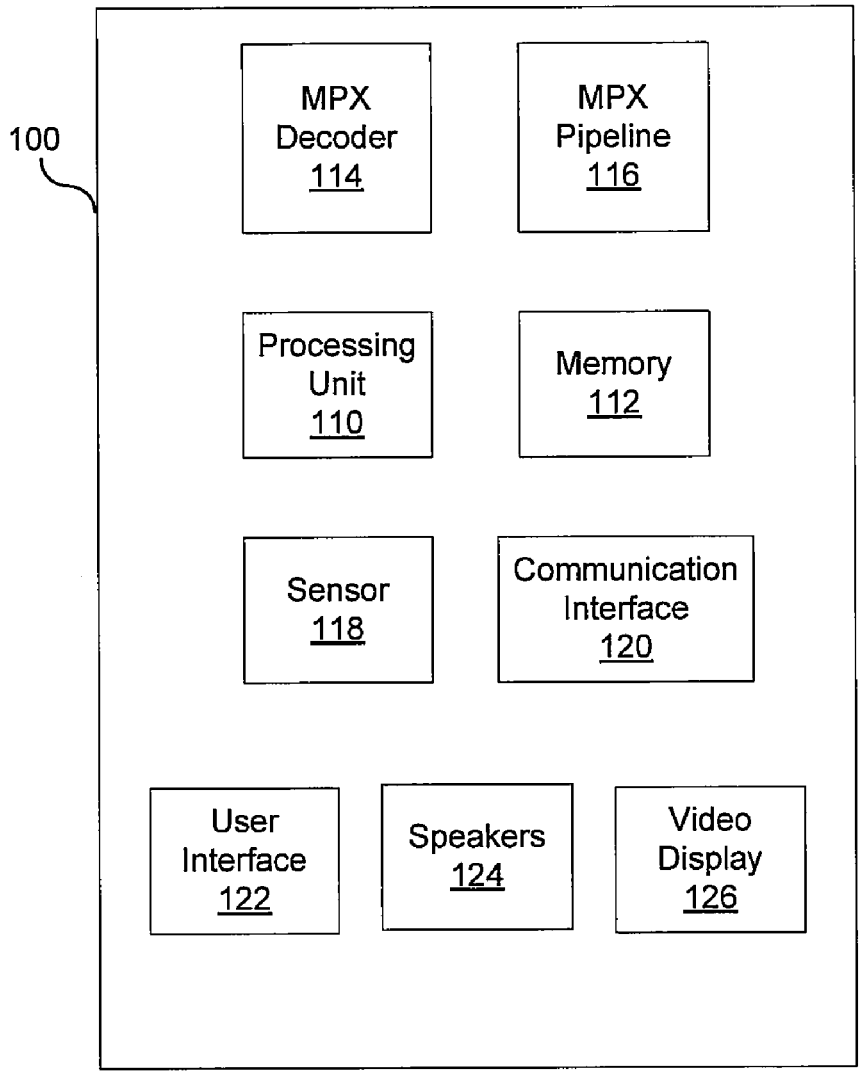
FIG. 1 is a block diagram illustrating an exemplary media playback device enabled to render media utilizing media processing extensions (MPX), in accordance with an embodiment of the invention.

FIG. 1 is a block diagram illustrating an exemplary media playback device enabled to render media utilizing media processing extensions (MPX), in accordance with an embodiment of the invention. Referring to FIG. 1, there is shown an exemplary MPX enabled media rendering device 100 comprising a processing unit 110, memory 112, a media processing extensions (MPX) decoder 114, a media processing pipeline 116, a sensor 118, a communications interface block 120, a user interface 122, a speaker 124 and a video display 126.

The media rendering device 100 may be enabled to process and/or render (or playback) audio and/or video data utilizing media processing extensions (MPX) information for playback settings. The media rendering device 100 may be part of one or more of a plurality of media delivery platforms such as a digital handheld audio and/or video playback device, a television, projection equipment, video and/or still camera display, electronic gaming or 3D gaming, a set top box, medical and scientific equipment, mobile phone, laptop, personal computer and/or home or commercial entertainment centers.

The processing unit 110 may comprise suitable logic, circuitry and/or code that may be operable to enable processing and rendering of multimedia data such as video and/or audio data (henceforth referred to as media or media data) utilizing MPX media playback settings. For example, the processing unit 110 may be utilized for video and/or audio playback utilizing integrated and/or external peripherals for example. Moreover, the processing unit 110 may be enabled to configure the processing pipeline 118 according to MPX data and manage the processing and rendering of media data accordingly. The processing unit 110 may be communicatively coupled with the memory 112, MPX decoder 114, processing pipeline 116, sensor 118, communication interface block 120, user interface 122, speakers 124 and video display 126.

The memory 112 may comprise suitable logic, circuitry and/or code for storing data. The memory 112 may be utilized to store media data prior to, during and/or after processing based on MPX data. In addition, the memory 112 may store MPX data and/or configuration data related to the processing pipeline 118. For example, user, device and/or environment profiles may be stored in the memory 112.

The MPX decoder 114 may comprise suitable logic, circuitry and/or code to read and decode MPX data that may determine processing pipeline configuration parameters, settings and/or pipeline components to be utilized in processing and rendering of media data. The MPX data may be stored in media files such as in a file header for JPEG, MP3 or MP4 files. In addition, the data may be stored in an MPX file such as a file comprising MPX data with the same name as a corresponding media data file and having a .mpx filename extension. Moreover, MPX data may be stored with media data as a property of an MTP or PTP object.

The MPX pipeline 116 may comprise suitable logic, circuitry and/or code that may enable the processing of media data according to MPX data corresponding to the media data. The MPX pipeline 116 may represent a video or still image processing pipeline and/or an audio processing pipeline. The MPX pipeline 116 may be configured based on MPX data. For example parameters or settings for the MPX pipeline 116 may be configured or updated based on MPX data. Moreover, the MPX pipeline components or processing steps may be adjusted, added or removed from the MPX pipeline 116. For example processing steps may be chained according to information provided by MPX data. The MPX pipeline 116 may be suited for audio and/or video data. Exemplary audio processing steps may comprise noise filtering, 3, 8 and/or 16 band equalization, dynamic compression and/or expansion and may chain one or more audio effects such as reverb, bass boost, 3D audio and surround sound processing for example. Exemplary video processing steps may comprise noise filtering, 3, 8 and/or 16 band equalization, color processing such as brightness, saturation and contrast and may chain video effects. The processing pipeline 116 may utilize third party audio and/or video effects. For example, the processing pipeline 116 may be enabled to apply reverb processing from a third party vendor. The processing pipeline 116 may be communicatively coupled with the processing unit 110, the MPX decoder 114 and the memory 112.

The sensor 118 may comprise suitable logic, circuitry and/or code to enable sensing of environmental conditions such as acoustical properties of the rendering environment or ambient light. Information obtained from the sensor 118 may be utilized to generate MPX data. For example, the sensor 118 may comprise a camera, light meter or microphone. In some embodiments of the invention, the sensor may be utilized to generate media data files, for example audio and/or video files. The sensor 118 may be communicatively coupled with the processing unit 110 and memory 112. The sensor 118 may be an optional feature of the MPX media rendering device 100. The invention is not limited to any specific type of sensor.

The communication interface block 120 may comprise suitable, logic, circuitry and/or code to receive or transmit information such as media and/or MPX data. For example, the communication interface block 120 may comprise communication interfaces for external memory, PC connections, external LCD or speakers, wireless connections, external sensors such as a camera. The invention is not limited to any specific type of communication interface and may comprise any communication interfaces suitable for bearing or communicating media data.

The user interface 122 may comprise suitable logic, circuitry and/or code for communicating processing commands and/or selections which may be required for audio or video data processing. The user interface may be for example a key pad or selection wheel. The invention is not limited to any specific type of user interface and may comprise any user interface suitable inputting user commands or selections.

The speakers 124 and/or video display 126 may be integrated within the MPX media rendering device 100 or may be external to the device. The speakers 124 and/or video display 126 may comprise suitable logic, circuitry and/or code to present media data processed and rendered via the MPX media rendering device 100. The invention is not limited to any specific type of speaker and/or video display, any suitable speakers and/or display may be utilized. For example headphones and/or still or motion displays may be utilized.

In operation, the MPX media rendering device 100 may receive media data via the communication interface 120 or via the sensor 118. The MPX media rendering device 100 may store the received media data in memory 112. The processing unit 110 may retrieve MPX data corresponding to the media data via one or more of a plurality of sources. The MPX data may be retrieved via the user interface 122, the sensor 118, the media data file, a separate MPX file and/or via MTP or PTP object properties within the media data object. The MPX decoder 114 may read and decode the MPX data corresponding to the received media data and the processing unit 110 may configure the processing pipeline 116 based on the corresponding MPX data. The MPX media rendering device 100 may process the received media data via the configured processing pipeline 116 and may render the media data via the speakers 124 and/or video display 126.

Figure 2:
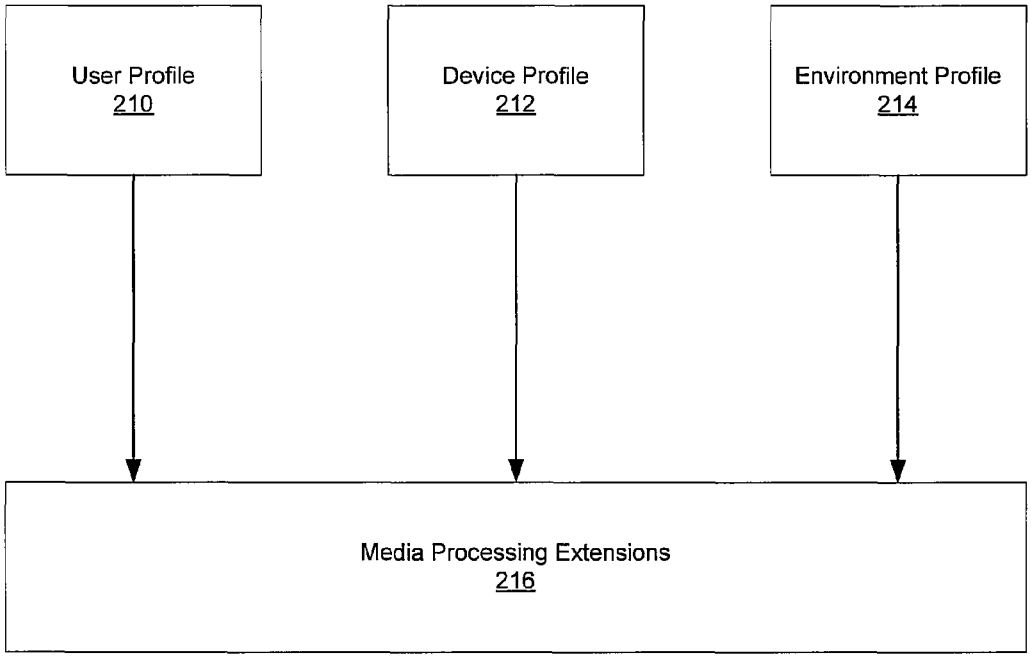
FIG. 2 is a block diagram illustrating exemplary sources for MPX data, in accordance with an embodiment of the invention.

FIG. 2 is a block diagram illustrating exemplary sources for MPX data, in accordance with an embodiment of the invention. Referring to FIG. 2, there is shown a user profile 210, a device profile 212, an environment profile 214 and media processing extensions (MPX) 216.

The user profile 210 may comprise media rendering device independent information representing a user's preferences for media playback settings for one or more media data files. For example, with regard to audio playback, the user profile 210 may comprise information regarding volume, dynamic compression and/or expansion. In addition, the user may select from preset audio playback setting options such as reverberation, bass boost, surround sound, 3D audio effects or presets for musical genres such as electronic or symphonic music. In another example, with regard to video playback, the user profile 210 may comprise information regarding brightness, color saturation and contrast. The user may, for example, select from preset video and/or audio playback settings for types of images such as early movies or contemporary films. In some embodiments of the invention, default settings may be utilized that may be associated with a particular media file or may be a default set within the media rendering device 100.

The device profile 212 may comprise information regarding characteristics and/or capabilities of the MPX media rendering device 100 and/or peripheral devices such as external speakers and/or image displays. In some embodiments of the invention, the device profile information may be generated in a lab and/or may be loaded on the MPX media rendering device 100 by a manufacturer or vendor. In some embodiments of the invention, a user may input device profile data or, for example, the MPX media rendering device 100 may detect peripherals and may load appropriate device profile information accordingly. For example, a user may select a type of speaker and/or display by brand such as Bose or Infinity speakers or a Sharp LCD display. The device profile 212 may comprise information regarding speaker and/or display characteristics and/or capabilities.

The environment profile 214 may comprise information regarding the environmental conditions surrounding the presentation of the media, for example, conditions that may affect the viewing or listening of rendered media. Information from the environment profile 214 may be utilized to compensate for the environmental conditions by adjusting effects, configuration and/or processing steps for the processing pipeline 116 prior to or during playback. For example, ambient lighting information and/or audio acoustical properties of a rendering environment may be utilized. In some embodiments of the invention, a user may input environment information or select from preset options such as indoor light, sunny or low light for video and/or background noise, in car or headphones for audio. In some embodiments of the invention, the environment profile 214 information may be received via the sensor 118. For example, retrieval of environment profile data 214 may be dynamically controlled via a program that may retrieve sensor 118 data and may adjust processing pipeline 116 configuration during the playback of media data.

The media processing extensions (MPX) 216 may comprise data based on information from one or more of the user profile 210, the device profile 212 and the environment profile 214. The MPX 216 data may be utilized by the MPX media rendering device 100 to determine playback settings for rendering media data. The MPX 216 data may correspond to one or more media data files and may be utilized to set up or configure the processing pipeline 116 for playback of the corresponding one or more media data files. The MPX 216 data may be stored via one or more of a plurality of methods. For example, MPX 216 data may be stored within a corresponding media data file. In this regard, the MPX 216 data may be stored within a file header, for example in the header of a JPG, MP3 and/or MP4 file. In another exemplary embodiment of the invention, the MPX 216 data may be stored in an MPX file that may be external to a corresponding media data file. For example, an external MPX file may be named with the same name of the corresponding media data file but may comprise a .mpx extension. In another embodiment of the invention, media data may be comprised within an MTP or PTP object. In this regard, MPX 216 data corresponding to the MTP or PTP object may be stored within the object's properties or in metadata properties associated with the object. In some embodiments of the invention, MPX 216 data pertaining to audio playback may be referred to as audio processing extensions (APX) and MPX 216 data pertaining to video or still image playback may be referred to as video processing extensions (VPX).

In operation, the MPX media rendering device 100 may retrieve MPX 216 data prior to or during the rendering of a media data file and may configure the processing pipeline according to the MPX 216 data. In this regard, one or processing steps or effects may be inserted within the processing pipeline 116 and/or parameters may be utilized to adjust or configure processing steps via the processing pipeline 116.

Figure 3:
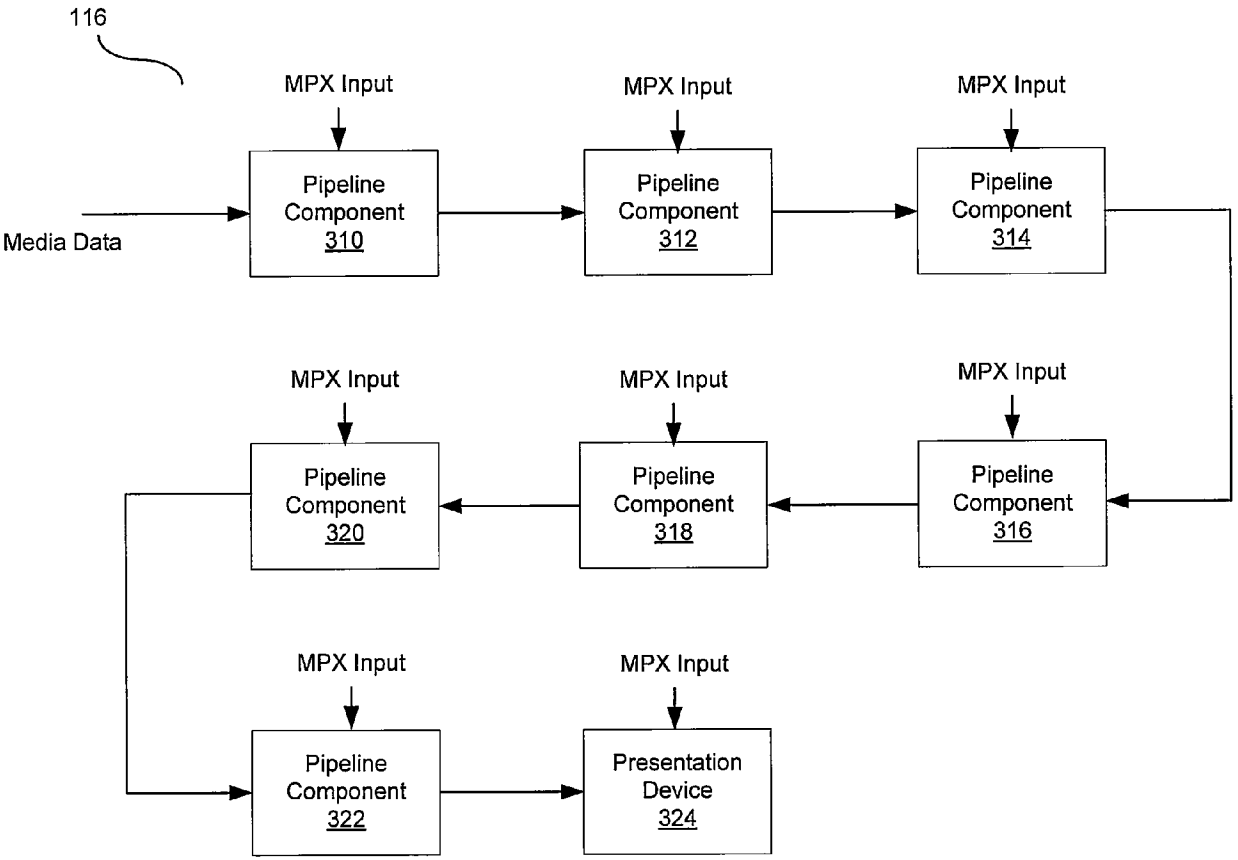
FIG. 3 is a diagram illustrating an exemplary MPX audio and/or video processing pipeline, in accordance with an embodiment of the invention.

FIG. 3 is a diagram illustrating an exemplary MPX audio and/or video processing pipeline, in accordance with an embodiment of the invention. Referring to FIG. 3 there is shown a plurality of pipeline components for the processing pipeline 116 comprising pipeline components 310, 312, 314, 316, 318, 320 and 322 as well as the presentation device 324.

The processing pipeline 116 may comprise pipeline components 310, 312, 314, 316, 318, 320 and 322 that may be utilized for processing media data prior to playback via the media rendering device 100. The pipeline components may be chained and may be enabled to handle audio and/or video, effects and/or processing steps. The effects and/or processing steps may be inserted into or removed from the pipeline 116 and/or may be adjusted or configured according to the MPX 216 data prior to processing and/or during processing of media data. The presentation device may be a video, or still image playback device and/or audio playback device for example. One or more of the pipeline components 310, 312, 314, 316, 318, 320 and 322 and/or the presentation device 324 may be enabled to receive MPX 216 information as parameters and may be enabled to adjust video or audio processing steps or effects accordingly. For audio processing, one or more pipeline components 310, 312, 314, 316, 318, 320 and 322 may be enabled to handle for example, noise filtering, equalization (3 band, 8 band or 16 band) and/or audio effects chaining such as reverb, bass boost, surround sound, dynamic compression, dynamic expansion and volume memory. For video or still image processing, the pipeline components 310, 312, 314, 316, 318, 320 and 322 may be enabled to handle for example, noise filtering, video equalization (3 band, 8 band or 16 band) and/or video effects chaining such as 3D video, color saturation and/or contrast for example. In some embodiments of the invention, various pipeline components may be provided by a third party vendor or manufacturer. For example reverb from a third party company may be utilized within processing pipeline 116.

In operation, prior to rendering a media data file, corresponding MPX 216 data may be decoded by the MPX decoder 114. Based on information from the corresponding MPX 216 data, one or more pipeline components 310, 312, 314, 316, 318, 320 and 322 and/or presentation device 324 may be selected and/or adjusted according to the decoded MPX 216 data. The media data may enter the processing pipeline 116 via the pipeline component 310 and may be processed via one or more of the pipeline components 310, 312, 314, 316, 318, 320 and 322. The media content may be displayed and or amplified via the presentation device 324. During the rendering process, additional MPX 216 information may be provided to one or more of the pipeline components 310, 312, 314, 316, 318, 320 and 322 and presentation device 324 and corresponding processing steps and/or effects may be adjusted.

Figure 4:
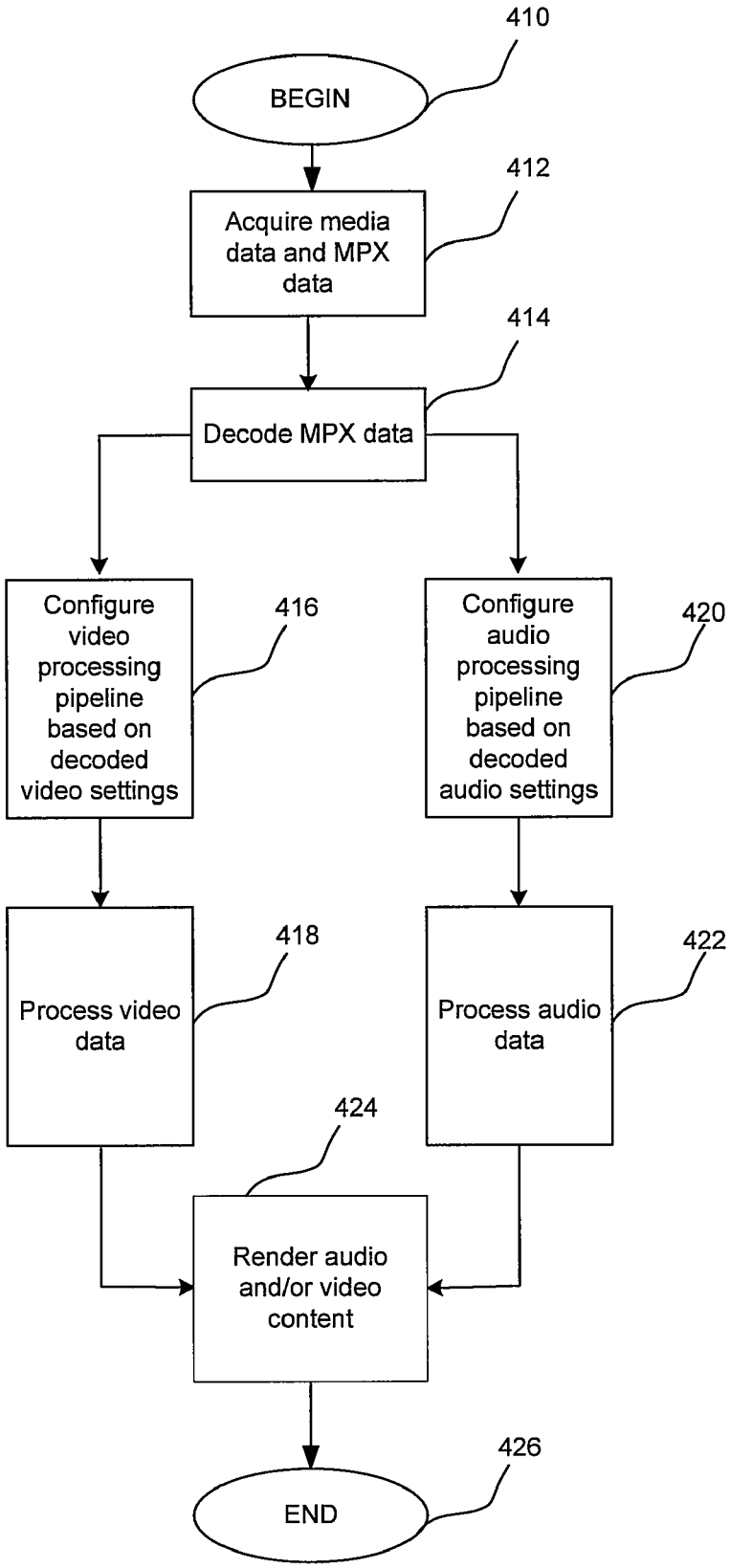
FIG. 4 is a flow chart illustrating exemplary steps for media playback utilizing MPX, in accordance with an embodiment of the invention.

FIG. 4 is a flow chart illustrating exemplary steps for media playback utilizing MPX, in accordance with an embodiment of the invention. Referring to FIG. 4, there is shown, start step 410, in step 412, the media rendering device 100 may acquire media data that may comprise audio and/or video data and corresponding MPX 216 data that may comprise audio and/or video MPX data. In step 414, the MPX 216 data may be decoded via the MPX decoder 114. In step 416, a video processing pipeline such as the processing pipeline 116 represented in FIG. 3, may have one or more pipeline components such as 310, 312, 314, 316, 318, 320 and 322 configured based on decoded MPX 216 data for video. In step 418, the media data comprising video data may be sent to the video processing pipeline and may be processed via the video processing pipeline. In step 420, an audio processing pipeline such as the processing pipeline 116 may have one or more pipeline components such as 310, 312, 314, 316, 318, 320 and 322 configured based on decoded MPX 216 data for audio. In step 422, the media data comprising audio data may be processed via the audio processing pipeline. In step 424, the processed video and/or audio content may be rendered via the presentation device 324. Step 426 may be an end of exemplary steps.

In an embodiment of the invention, a media rendering device 100 that may be enabled to handle media data and media processing extension (MPX) 216 data, may decode MPX 216 data corresponding to the media data. Based on the decoded MPX data, one or more of processing steps, for example, pipeline components 310-324, and/or processing parameters for processing the media data may be determined. In this manner, the media data may be processed and/or rendered according to the determination. Notwithstanding, the processing steps, for example, pipeline components 310-324, and processing parameters may be dynamically determined and/or adjusted during the processing and/or rendering by the media rendering device 100.

The MPX 216 data may be generated, stored and/or restored based on a user preference profile 210, media rendering device profile 212 and/or a media rendering environment profile 214. Furthermore, the MPX 216 data may be stored in a plurality of ways, for example, within a file that may comprise corresponding media data, within a file that may be external to the file that may comprise corresponding media data and/or within an MTP or PTP object property associated the media data. In addition, the MPX 216 data may be input, for example, by a user, manufacturer or a vendor. Moreover, the MPX 216 data may be independent of a specific type of device, for example, MPX 216 data may be effective within a plurality of media devices. In accordance with an embodiment of the invention, the media data may comprise one or more of video data, still image data and audio data, for example.

Another embodiment of the invention may provide a machine and/or computer readable storage and/or medium, having stored thereon, a machine code and/or a computer program having at least one code section executable by a machine and/or a computer, thereby causing the machine and/or computer to perform the steps as described herein for a method and system for media processing extensions (MPX) for audio and video setting preferences.

Accordingly, the present invention may be realized in hardware, software, or a combination of hardware and software. The present invention may be realized in a centralized fashion in at least one computer system or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method for processing data, the method comprising:
in a media rendering device enabled to handle media data and media processing extension (MPX) data:
decoding said MPX data for processing of said media data, wherein:
said decoded MPX data is utilized to configure a media processing pipeline; and
said media processing pipeline is utilized to process said media data for playback by said media rendering device; and
determining based on said decoded MPX data, one or more of said processing steps and/or processing parameters for said processing said media data by said media processing pipeline; and
processing and/or rendering said media data by said media processing pipeline based on said determination.

2. The method according to claim 1, comprising generating, storing and/or restoring said MPX data based on a user preferences profile, a media rendering device profile and/or a media rendering environment profile.

3. The method according to claim 1, comprising storing said MPX data within a file comprising said media data.

4. The method according to claim 1, comprising storing said MPX data in a file external to a file comprising said media data.

5. The method according to claim 1, comprising storing said MPX data in an MTP or PTP object property associated with said media data.

6. The method according to claim 1, wherein said MPX data is device independent.

7. The method according to claim 1, wherein said media data comprises one or more of video data, still image data and audio data.

8. The method according to claim 1, comprising dynamically determining and/or adjusting said one or more of said processing steps and said processing parameters for processing said media data during said processing and/or rendering by said media rendering device.

9. The method according to claim 1, wherein said MPX data is input by one or more of a user, manufacturer or vendor.

10. A system for processing data, the system comprising:

one or more circuits for use in a media rendering device, wherein said one or more circuits are operable to handle media data and media processing extension (MPX) data, and said one or more circuits are operable to:

decode said MPX data for processing of said media data, wherein:

said decoded MPX data is utilized to configure a media processing pipeline; and said media processing pipeline is utilized to process said media data for playback by said media rendering device; and determine, based on said decoded MPX data, one or more of processing steps and/or processing parameters for processing said media data by said media processing pipeline; and process and/or render said media data by said media processing pipeline based on said determination.

11. The system according to claim 10, wherein said one or more circuits is enabled to generate, store and/or restore said MPX data based on a user preferences profile, a media rendering device profile and/or a media rendering environment profile.

12. The system according to claim 10, wherein said one or more circuits is enabled to store said MPX data within a file comprising said media data.

13. The system according to claim 10, wherein said one or more circuits is enabled to store said MPX data in a file external to a file comprising said media data.

14. The system according to claim 10, wherein said one or more circuits is enabled to store said MPX data in an MTP or PTP object property associated with said media data.

15. The system according to claim 10, wherein said MPX data is device independent.

16. The system according to claim 10, wherein said media data comprises one or more of video data, still image data and audio data.

17. The system according to claim 10, wherein said one or more circuits is enabled to dynamically determine and/or adjust said one or more of said processing steps and said processing parameters for processing said media data during said processing and/or rendering by said media rendering device.

18. The system according to claim 10, wherein said MPX data is input by one or more of a user, manufacturer or vendor.

19. A non-transitory machine-readable storage having stored thereon, a computer program having at least one code section for processing data, the at least one code section being executable by a machine for causing the machine to perform steps comprising:

in a media rendering device enabled to handle media data and media processing extension (MPX) data:

decoding MPX data for processing of said media data, wherein:

said decoded MPX data is utilized to configure a media processing pipeline; and said media processing pipeline is utilized to process said media data for playback by said media rendering device; and determining based on said decoded MPX data, one or more of processing steps and/or processing parameters for said processing said media data by said media processing pipeline; and processing and/or rendering said media data by said media processing pipeline based on said determination.

20. The non-transitory machine-readable storage according to claim 19, wherein said at least one code section comprises code for generating, storing and/or restoring said MPX data based on a user preferences profile, a media rendering device profile and/or a media rendering environment profile.

21. The non-transitory machine-readable storage according to claim 19, wherein said at least one code section comprises code for, storing said MPX data within a file comprising said media data.

22. The non-transitory machine-readable storage according to claim 19, wherein said at least one code section comprises code for storing said MPX data in a file external to a file comprising said media data.

23. The non-transitory machine-readable storage according to claim 19, wherein said at least one code section comprises code for storing said MPX data in an MTP or PTP object property associated with said media data.

24. The non-transitory machine-readable storage according to claim 19, wherein said MPX data is device independent.

25. The non-transitory machine-readable storage according to claim 19, wherein said media data comprises one or more of video data, still image data and audio data.

26. The non-transitory machine-readable storage according to claim 19, wherein said at least one code section comprises code for dynamically determining and/or adjusting said one or more of said processing steps and said processing parameters for processing said media data during said processing and/or rendering by said media rendering device.

27. The non-transitory machine-readable storage according to claim 19, wherein said MPX data is input by one or more of a user, manufacturer or vendor.

* * * * *